United States Patent [19]

Amado, Jr.

[11] 4,336,702

[45] Jun. 29, 1982

[54] METHOD OF AND APPARATUS FOR MAKING SPIRAL TUBES

[76] Inventor: Juan J. Amado, Jr., Aptdo. 4241, Panama City, Panama

[21] Appl. No.: 186,658

[22] Filed: Sep. 12, 1980

[51] Int. Cl.[3] ..... B21D 15/04

[52] U.S. Cl. ..... 72/75; 72/78

[58] Field of Search ..... 72/75, 77, 78, 96

[56] References Cited

U.S. PATENT DOCUMENTS

| | | | |
|---|---|---|---|
| 629,245 | 7/1899 | Frank | 72/75 |
| 1,068,549 | 7/1913 | Westin | 72/78 |
| 3,007,504 | 11/1961 | Clark | 279/1 M |
| 3,630,058 | 12/1971 | Kiplinger et al. | 72/76 |
| 3,727,443 | 4/1973 | Quinlan | 72/75 |
| 3,768,291 | 10/1973 | Rieger | 72/78 |

FOREIGN PATENT DOCUMENTS

| | | | |
|---|---|---|---|
| 990321 | 4/1965 | United Kingdom | 72/75 |

*Primary Examiner*—Lowell A. Larson

*Attorney, Agent, or Firm*—Richard P. Matthews

[57] ABSTRACT

A method of and apparatus for forming spirally-shaped indentations in tubular products. An internal shaft is formed with a spirally-shaped female die and an outside die consists of a single metal ball magnetically suspended from the outside die holder in registry with the spiral formation on the internal female die. The tube to be formed extends between the two dies and is clamped to prevent rotation but permitted to move in either axial direction. A threaded insert in the external die is advanced axially and then locked to predetermine the maximum indentation to be impressed into the tubular product. Thereafter, a reversible motor drives a holder for the external die and the internal shaft in unison to form a spiral indentation in the tubular product.

10 Claims, 3 Drawing Figures

METHOD OF AND APPARATUS FOR MAKING SPIRAL TUBES

This invention relates to a method of and apparatus for forming spirally-shaped indentations in tubular products and, more particularly, to such a method and apparatus wherein the tube is formed from a single metal ball.

BACKGROUND OF THE INVENTION

Heretofore it has been known to use metal balls to form tubular products and to form spiral indentations therein. One of these is my own U.S. Pat. No. 4,196,608 which issued on Apr. 8, 1980. While the method and apparatus described therein continue to be satisfactory, there are some applications where deeper indentations are desirable than can be produced by the teaching of U.S. Pat. No. 4,196,608 without rupturing the pipe.

One other difficulty encountered in the invention practiced in my U.S. Pat. No. 4,196,608 is that the use of a plurality of balls to perform the spiral formation of the pipe was that the spiral configurations were not always sharply defined. This is caused by differences in position of one ball with respect to another vis-a-vis the die track and also because of die wear and differential ball wear.

SUMMARY OF THE INVENTION

The foregoing difficulties and shortcomings experienced in the prior art as typified by my U.S. Pat. No. 4,196,608 are effectively overcome in the practice of the present invention. In particular, it is possible to achieve greater depths of indentations in the spiral grooving of a pipe or tubular product, either metal or plastic, because the stresses imparted to the tubular product by decreasing the diameter of the product are less likely to rupture the product than by increasing the diameter as in U.S. Pat. No. 4,196,608.

It is also advantageous to use a single ball to form the indentations in the tubular product both from the standpoint of greater uniformity of the spiral grooves and also in making a more clearly defined groove or indentation.

DESCRIPTION OF THE DRAWINGS

The inherent advantages and improvements in the present invention will become more readily apparent upon consideration of the following detailed description of the invention and by reference to the drawings wherein.

DETAILED DESCRIPTION OF A PREFERRED EMBODIMENT

Figure 1:
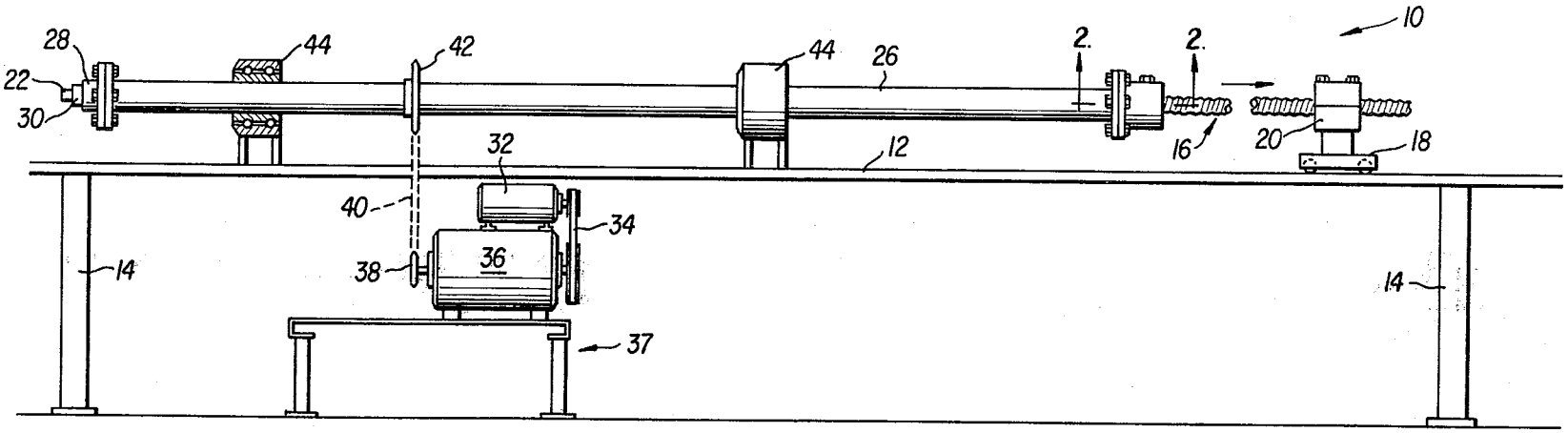
FIG. 1 is a front elevational view showing the apparatus for making spiral tubes in accordance with the present invention.
Figure 3:
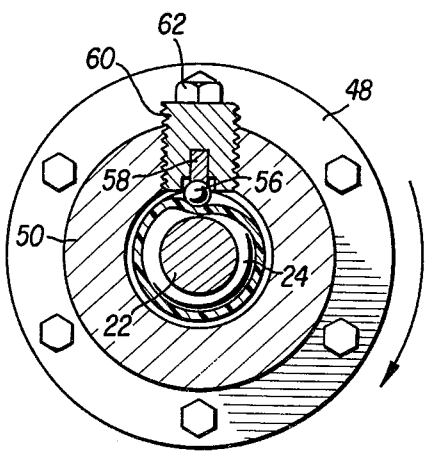
FIG. 3 is an end elevational view, taken in vertical cross section, along line 3—3 of FIG. 2.

Referring now to FIG. 1 in the drawings, there is illustrated a spiral tube forming apparatus indicated generally at 10 having a work surface 12 supported by suitable frame or leg members 14. A formed spiral tubing is indicated generally at 16 and this is received in a trolley or car-like device 18 which rolls on the work surface 12 to permit axial movement of the spiral tubing in either direction. The car-like device 18 has suitable clamping means 20 which receive and prevent rotation of the formed spiral tubing.

Figure 2:
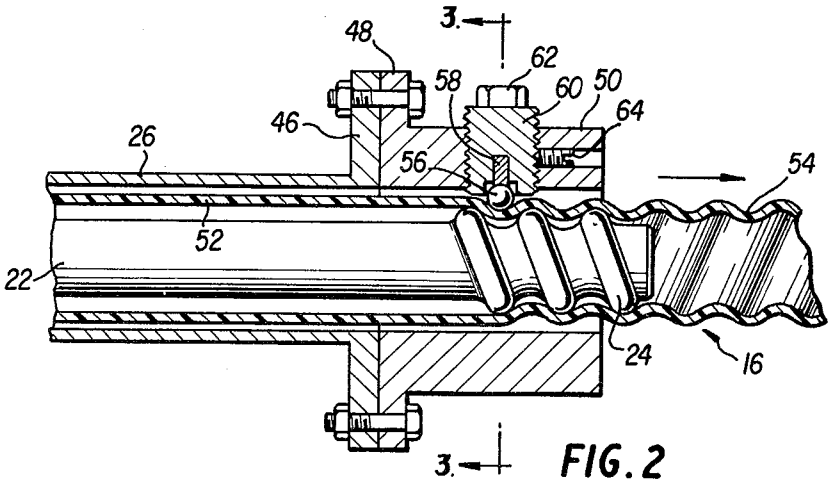
FIG. 2 is a fragmentary elevational view taken in vertical cross section along line 2—2 of FIG. 1.

Referring now to FIG. 2 there is illustrated an internal rotating shaft 22 which has a spiral die track means 24 externally formed adjacent the end thereof. An external die holder is illustrated at 26 provided with an adapter 28, FIG. 1, which is attached by means of a suitable key member 30 to the internal rotating shaft 22.

The means for rotating both the internal rotating shaft 22 and external die holder 26 in unison is illustrated to comprise a reversible electric motor 32 whose output shaft powers a drive belt means 34 which, in turn, drives a speed reducer 36. The reversible electric motor 32 and speed reducer 36 are supported by means of a suitable foundation or drive support means 37 as is indicated generally in FIG. 1. The output shaft of speed reducer 36 carries an output sprocket 38 which is connected by a chain or other drive means 40 to a sprocket 42 fixedly secured to the external die holder 26. Bearing members 44, shown in FIG. 1, support the entire spiral tube forming apparatus above the work surface 12 in FIG. 1.

Referring again to FIG. 2, the external die holder 26 is provided with a flange 46 which is suitably bolted to a mating flange 48 on a rotatable outside male die holder 50. The unformed tubing is shown at 52 in FIG. 2 with the indentations 54 constituting the spiral tube being formed by a metal ball 56 which is suspended magnetically from a magnet 58 in a threaded insert metal ball holder 60 of the male die holder 50. A nut 62 provides a convenient means for advancing and retarding the insert metal ball holder 60 and set screw means 64 provide means for locking the metal ball holder in place.

The operation of the apparatus for forming the spiral tubes will become more readily apparent upon considering the following method steps used in the practice of this invention:

1. Providing a female spirally-shaped die track on a rotatable shaft;
2. Suspending a single metal ball from a rotatable holder with the ball being positioned in registry with the die track;
3. Inserting a tube to be formed between the die track and the metal ball;
4. Clamping the tube to be formed so as to prevent rotation thereof while permitting axial movement of the tube;
5. Advancing the metal ball to obtain a desired radial inward depressing of the tube to be formed; and
6. Rotating the rotatable holder and the rotatable shaft in unison to form a spirally-shaped groove in the tube.

Additional and auxiliary method steps include those of magnetically supporting the metal ball from the rotatable holder, threadedly advancing a holder for the metal ball in order to obtain the desired radial inward depression of the tube to be formed, and using a trolley-like member which rolls on a working surface in providing the clamping of the tube to be formed.

It is advantageous to be able to employ a reversible electric motor 32 so that the spiral can be formed in the tube all the way to the end of the tubing thereby resulting in less scrap metal. Also this facilitates some work hardening of metal tubes and insures the full depth of the indentations in the tubing. It has been found that rotational speeds may be used from 50 to 120 revolutions per minute with the tubing being produced at from two to eight feet per minute. Plastic tubing needs some application of heat to be formed properly. It is preferred to lubricate both the ball and the internal die spiral. Lubrication is performed both prior to and during the formation of the tubing. Since it is possible to reverse the rotation of the machine the tubing can be formed while going inward as well as coming outwards. It is normal to lubricate by pumping the lubricant into the die opening as the tubing goes inwards. The principal elements of the tube forming apparatus must be changed for every size of tubing. Thus, the outside die, the internal die and the ball holder are changed to provide the proper size of tubing and desired depth of indentation. The metal ball rotates against the magnet with the friction being quite low. The metal ball itself is made from hard steel while the internal die spiral is made from a strong anti-friction metal such as bronze.

While a presently preferred embodiment of the invention has been illustrated and described, it will be recognized that the invention may be otherwise variously embodied and practiced within the scope of the claims which follow.

That which is claimed is:

1. A method of forming spiral tubes which comprises the steps of a. providing a female spirally shaped die track on a rotatable shaft, b. suspending only a single metal ball from a rotatable holder with said ball being positioned in registry with said die track, c. inserting a tube to be formed between said die track and said metal ball, d. clamping said tube to be formed so as to prevent rotation thereof while permitting axial movement of said tube, e. advancing said metal ball to obtain a desired radial inward depression in said tube to be formed, f. and rotating said rotatable holder and said rotatable shaft in unison to form a spirally-shaped groove in said tube.

2. A method of forming spiral tubes as defined in claim 1 including the additional step of magnetically supporting said metal ball from said rotatable holder.

3. A method of forming spiral tubes as defined in claim 1 including the additional step of threadedly advancing a holder for said metal ball in order to obtain the desired radial inward depression in said tube to be formed.

4. A method of forming spiral tubes as defined in claim 1 including the additional step of using a trolley-like member which rolls on a working surface in providing the clamping of the tube to be formed.

5. An apparatus for forming spiral tubes which comprises:

a. a spirally-shaped female die means formed on a rotatable shaft, b. only a single metal ball positioned in registry with said spirally-shaped female die means, c. rotatable holding means for said metal ball, d. means within said rotatable holding means for advancing said metal ball axially towards a tube to be formed and for forming therein a depression of desired depth, e. means for clamping the formed tube to prevent it from rotating but permitting axial movement of the formed tube, f. and means for rotating said rotatable shaft and said rotatable holding means in unison.

6. An apparatus for forming spiral tubes as defined in claim 5 including magnetic means for suspending said metal ball from said rotatable holder.

7. An apparatus for forming spiral tubes as defined in claim 5 including a threaded insert within said rotatable holder which permits threaded axial advancement of said metal ball.

8. An apparatus for forming spiral tubes as defined in claim 7 including means to lock said threaded insert in position so as to control the depth of the spiral depression in the tube being formed.

9. An apparatus for forming spiral tubes as defined in claim 5 including a trolley-like member which carries said clamping means with said trolley having wheels engaging a working surface.

10. An apparatus for forming spiral tubes as defined in claim 5 wherein said means for rotating said rotatable shaft and said rotatable holding means in unison includes a reversible motor means so that said tube can be formed in opposite axial directions.

* * * * *